United States Patent [19]

Fisher et al.

[11] 3,969,061

[45] July 13, 1976

[54] CONCRETE PRESS WITH MOLD CLAMPING MEANS

[75] Inventors: Howard M. Fisher; Bernd G. Albers, both of New Castle, Pa.

[73] Assignee: Pennsylvania Engineering Corporation, Pittsburgh, Pa.

[22] Filed: Oct. 29, 1973

[21] Appl. No.: 410,455

Related U.S. Application Data

[63] Continuation of Ser. No. 225,575, Feb. 11, 1972, abandoned.

[52] U.S. Cl. ..... 425/423; 425/150; 425/410; 425/454

[51] Int. Cl.[2] ..... B28B 3/00

[58] Field of Search ..... 425/412, 423, 405 H, 425/453–454, 440, DIG. 44, DIG. 124, 345, 358–359, 406, 410–411, 413, 450–451, 150; 74/252, 448

[56] References Cited

UNITED STATES PATENTS

| | | | |
|---|---|---|---|
| 1,998,117 | 4/1935 | Brush | 425/450 C |
| 2,038,205 | 4/1936 | Case | 425/423 |
| 2,786,254 | 3/1957 | Olson | 425/432 |
| 2,820,250 | 1/1958 | Stratton | 425/406 |
| 3,195,186 | 7/1965 | Gauban et al. | 425/450 C |
| 3,553,798 | 1/1971 | Reckman et al. | 425/126 |
| 3,640,660 | 2/1972 | De Mets | 425/411 |
| 3,667,880 | 6/1972 | Malet et al. | 425/3 |

FOREIGN PATENTS OR APPLICATIONS

| | | | |
|---|---|---|---|
| 440,568 | 7/1967 | Switzerland | 164/207 |

*Primary Examiner*—Francis S. Husar
*Assistant Examiner*—John McQuade
*Attorney, Agent, or Firm*—Fred Wiviott

[57] ABSTRACT

A concrete press has an upper movable platen and a lower fixed platen. Hydraulic cylinders are interposed between the upper platen and frames of the press which extend horizontally over this platen. A mold shaped as a concrete building panel is filled with high water-to-cement ratio concrete and is introduced between the platens for pressing. The mold has collapsible interleaving sides. Lateral hydrostatic pressure on the short ends of the molds is resisted with hydraulic rams. Hydrostatic pressure against the long sides of the molds is resisted by hydraulically positioned wedges which are interposed between the mold sides and the frames which contain the platens and cylinders. Means which are responsive to the cylinder positions are provided for maintaining all parts of the movable platen level during the compacting process. The mold sections are prevented from collapsing inadvertently with magnet means.

10 Claims, 8 Drawing Figures

CONCRETE PRESS WITH MOLD CLAMPING MEANS

This is a continuation of application Ser. No. 225,575, filed Feb. 11, 1972, now abandoned.

BACKGROUND OF THE INVENTION

This invention relates to apparatus for making concrete panels such as are used for erection of a building.

The desirability of constructing a building with precast concrete panels has been recognized for a long time but has not been practiced extensively. Both economic and technical problems have deferred widespread use. The major problem was economic in that mass production of panels or building components was not feasible using conventional methods of casting and curing concrete. Normally concrete must cure for at least 4 to 6 hours in a heated mold before demolding can be attempted. As a result of this long curing cycle, production facilities were occupied for long periods requiring costly duplication. An additional disadvantage of cast panels is the difficulty in obtaining dimensional accuracy, a good surface finish and high strength.

Some of the disadvantages of the foregoing conventional method have been overcome by making concrete articles in a mold which is inserted in a press to squeeze out water and thus reduce the time required before demolding. In this process, the mold is first filled with a concrete slurry having a water-to-cement ratio of about 0.7 to 1. Such concrete would have low strength if it were cured by just waiting for the normal hydration process to be completed. However, by pressing the concrete, sufficient water is expelled to reduce its water-to-cement ratio to the range of 0.3–0.4 to 1. With this lower ratio the concrete article attains sufficient strength to be handled immediately upon removal from the press, and its final strength will be considerably higher (almost 100%) than cast concrete with the same water, cement and aggregate ratio.

Reducing the water-to-cement ratio by pressing the concrete accelerates production but the process is not free of problems. First of all, presses which produce high total force on a relatively large area are required. Usually a unit pressure of more than several hundred pounds per square inch is required for adequate water removal and concrete density. For example, in order to produce panels of about 12 feet by 24 feet, presses having a total capacity of as much as 8,000 tons of pressure are required. The structural components of such presses must be substantially heavy.

Another difficulty in pressing building panels results from the necessity for door and window openings. When these panels are pressed there is a tendency for the platens of the press to deform in those regions where resistance is low because the presence of such an opening. This would result in a panel of nonuniform thickness. In some plants, total tonnage of the press is adjusted to compensate for openings in the molded article but in order to keep the platen deflections within reasonable limits, the platen had to be extremely stiff and a force absorbing guidance system was required, resulting in a considerably increase in weight of the press.

Another problem with prior presses is that the molds tend to bulge out at the sides due to lateral hydrostatic pressure which is developed while the concrete is being compacted. Molds of inordinate thickness had been used to resist this pressure. Molds that are sufficiently rigid to resist the lateral forces by themselves are unduly heavy and hard to handle.

SUMMARY OF THE INVENTION

An object of this invention is to provide a press for making molded concrete articles of higher quality and more rapidly than was heretofore possible.

A further object of the invention is to provide a press capable of pressing large concrete slabs wherein the structural components thereof are not inordinately large.

Another object is to provide a press in which deformation of the platen that would otherwise result from the lack of uniform resistance to the compressive forces is compensated by sensing the positions of the rams in the various hydraulic cylinders which press the platen and adjusting the pressure on the rams in given areas in such manner that all parts of the platen come down uniformly.

A further object of this invention is to provide means for resisting the lateral hydrostatic forces which are developed on the sides of the mold when pressure is exerted on its top face. A corollary to this object is to have a press which is composed of several frames whose bottom parts support a stationary platen and which has the hydraulic cylinders disposed between an upper part of the frames and the movable platen so as to develop bending in the upper and lower parts and tension in the legs of the frames during pressing. This bending causes the legs to deform slightly inward insuring contact between the elements which are interposed between the frames and the mold and at the same time the lateral hydrostatic forces pushing against the frames create a counter moment in the frames reducing the bending stresses particularly in the lower half.

A still further object of the invention is to provide concrete molds which yield in the direction in which they are pressed as a result of being made in separable collapsible sections which sections are held together by novel magnetic means.

In general terms, the new concrete press comprises several open-centered frames that are held in spaced apart parallelism with each other by means of tie-rods and spacers. A stationary lower platen is supported on the lower laterally extending portions of the frames. An upper platen is mounted for rapid vertical movement by hydraulic jacks supported from upper laterally extending portions of a structural frame. Hydraulic cylinders operable to produce the high pressures required for pressing the concrete article are interposed between the upper movable platen and the upper laterally extending portions of the frames. The position of the ram in each high pressure cylinder is constantly sensed during pressing so that if one ram gets ahead of or falls behind any of the others, the pressure on that ram is automatically adjusted in response to signals produced by the ram position sensor so that the platen is maintained level everywhere and the molded article has uniform thickness. Hydraulically operated wedges are positioned between the side legs of the frames and the mold sides to resist lateral hydrostatic pressure during pressing. Bending in the upper and lower parts of the frame plates tends to cause slight inward buckling of the frame legs insuring contact at all times. The ends of mold are prevented from bulging due to lateral hydrostatic pressure by means of hydraulically operated jaws which act on the mold ends. Magnetic means are used to maintain the collapsible molds in an extended state until they are pressed.

How the foregoing and other more specific objects are achieved will appear throughout the course of a more detailed description of a preferred embodiment of the invention which will be set forth shortly hereinafter in reference to the drawing.

DESCRIPTION OF A PREFERRED EMBODIMENT

Figure 1:
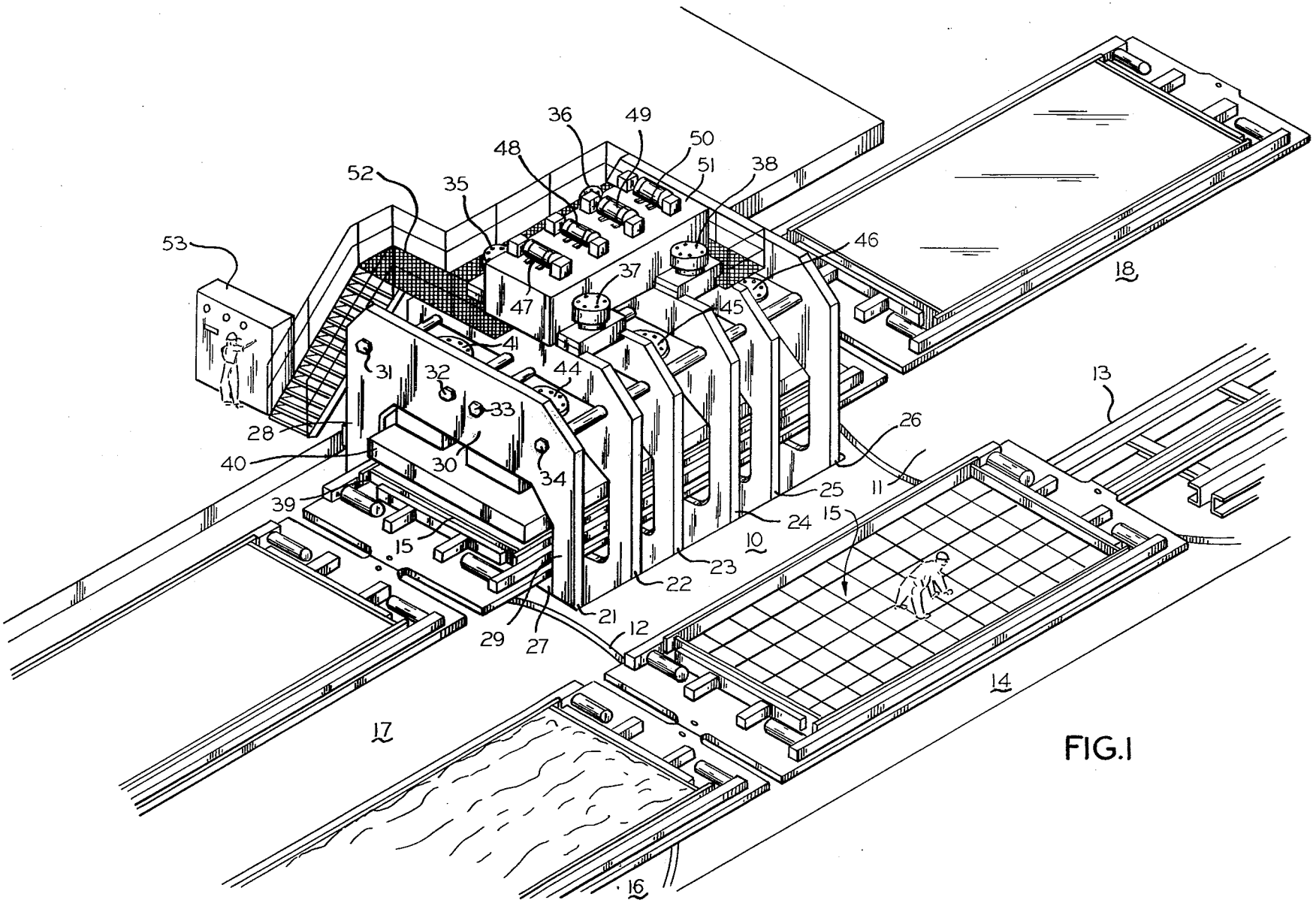
FIG. 1 illustrates a general layout of a plant for making pressed concrete articles and showing in schematic perspective the press and its affiliated mold preparing and handling facilities.

FIG. 1 illustrates the general configuration of a concrete press 10 and associated facilities. Adjacent the press are turntables 11 and 12 for handling the concrete molds before and after an article has been formed in them by pressing. Empty molds may be positioned on tracks 13 which are shown unoccupied and mounted on turntable 11. Molds that are ready for use are first positioned on a suitable base which is movable on tracks 13 after which the mold may be transferred to a preparation position adjacent the press 10 and which identified by the numeral 14. The mold used for exemplification purposes in FIG. 1 is rectangular and is marked generally with the reference numeral 15.

At position 14, the mold may be prepared for receiving concrete slurry. This often involves the insertion of reinforcing rods and the setting of insert frames (not shown) in the mold for developing window and door openings and the like. Usually at this juncture, perforated steel plates and porous sheet material, such as paper, are laid on the upper face of the base's planar base. The porous sheet material, not shown in FIG. 1, is for permitting the exit of water from the concrete when it is in the press as will be explained more fully below. After the mold is prepared at position 14, the mold and the base which supports it are transferred on tracks to turntable 12 which is designated as position 16. From hoppers which are not shown in FIG. 1, concrete slurry is fed into the mold 15 and is spread around until the concrete thickness is substantially equal to the mold thickness. After the concrete has been substantially leveled, a porous sheet and perforated steel plate is placed atop the slurry and the turntable 12 then is rotated so as to locate the mold in position 17 which is the input station for press 10. The mold and its base are then advanced into the press while the platens of the press are widely separated after which the movable platen is advanced toward the mold to press the mold against the stationary platen and thereby squeeze water from the mold and compact the concrete. In approximately one minute, the press is relieved and the mold is conveyed from the press to output position 18 on turntable 11. Tracks, which are not shown in FIG. 1, but which are similar to tracks 13 and abut tracks on which the mold is supported in position 18, are then used to transport the mold off of the turntable and to a demolding station. The molded, uncured concrete product may remain on a base plate after demolding and during the ensuing step which is to accelerate curing of the product such as in a kiln.

The general features of the press according to the preferred embodiment of the invention will first be outlined in reference to FIG. 1 before elucidating the features of novelty in reference to the other figures.

In FIG. 1 the press is seen to comprise a plurality of similar open-centered frames 21-26. While six frames are shown in FIG. 1, those skilled in the art will appreciate that more or less may be used, depending on the size of the press. Frame 21, which is typical of all the frames 21-26 has a laterally extending lower or base portion 27, side legs 28 and 29 and a laterally extending top portion 30. The frames are held in parallelism by tie-bolts 31–34 in addition to other means which will be more fully discussed below. Within the openings defined by frames 21-26 and supported on lower transverse or laterally extending members 27 of the frames, is a stationary platen which is generally designated with the numeral 39 in FIG. 1. A vertically movable platen generally designated by the numeral 40 is substantially congruent with stationary platen 39 and is also in the opening defined by the frames 21–26.

Hydraulic jacks 35–38 are engaged with upper movable platen 40 and are used to raise and lower the platen rapidly from and toward its pressing position. These jacks merely require the capability of lifting and holding platen 40 in any position. The high pressure force used to squeeze platen 40 against a mold which is interposed between it and stationary platen 39 is developed by a plurality of high-powered hydraulic cylinders which are generally designated by the numerals 41–46, cylinders 42 and 43 are not visible in FIG. 1. Here again, while six such cylinders are illustrated in the preferred embodiment of the invention, the number will be determined by the size of the article to be pressed and the pressure requirements of the system. As will be discussed more fully below, these high-pressure cylinders are interposed between laterally extending portions 30 of the press frames and the platen so that when the cylinders generate pressure, the forces are absorbed by the frames 21–26 with the side legs 28 and 29 of the frames being put in tension.

Some of the auxiliary components such as motor and hydraulic pump assemblies 47-50 are also shown in FIG. 1. These pump assemblies are mounted on a hydraulic fluid reservoir or tank 51 which is supported on a suitable platform above the press. A stairway and platform 52 is provided for enabling maintenance and inspection of the press. Adjacent the stairway is a control console 53 where the operator of the press directs its operation.

Figure 2:
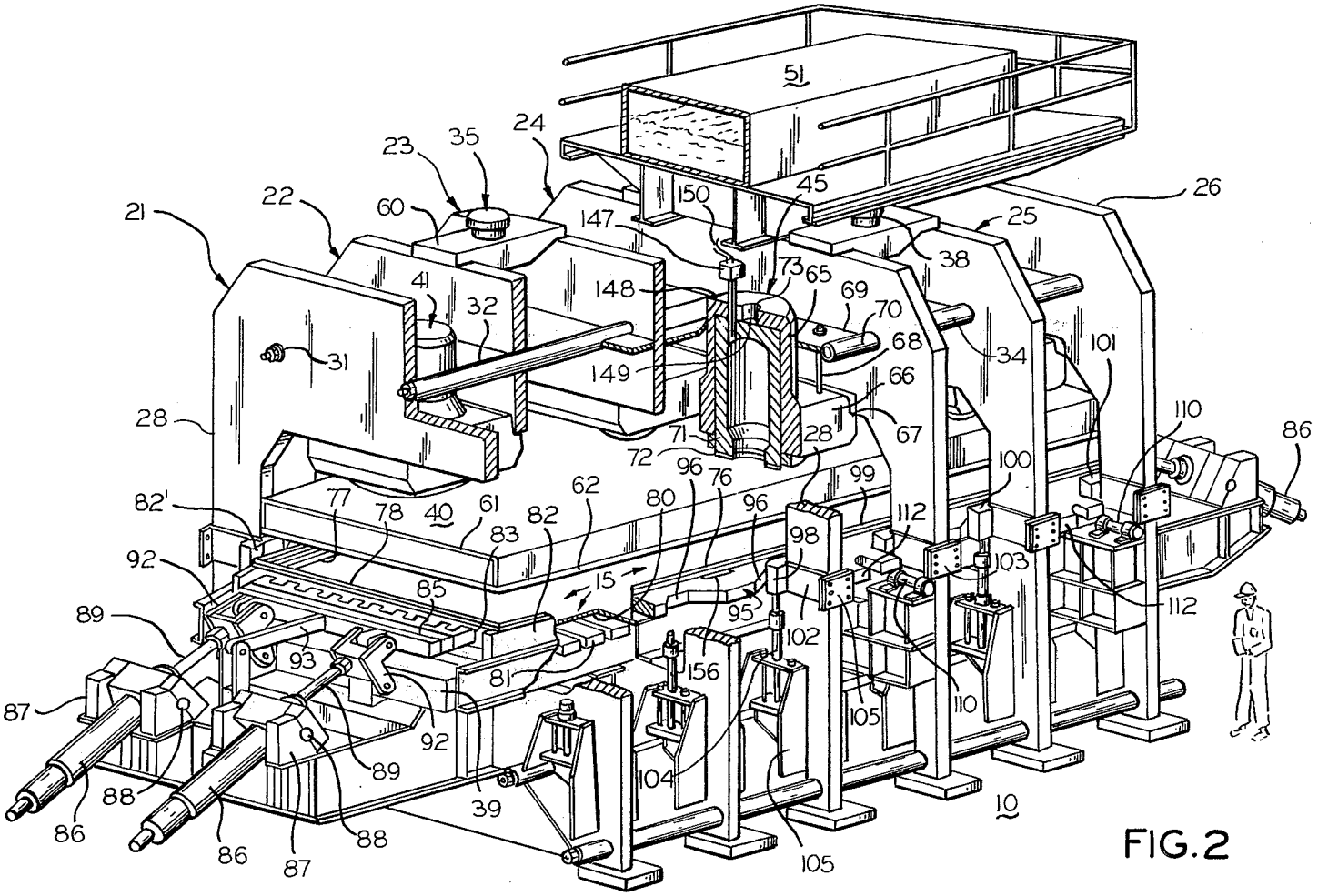
FIG. 2 is a perspective view of the concrete press according to a preferred embodiment of the invention with parts broken away to show certain constructional details thereof.

Reference is now made to FIG. 2, in connection with which a more explicit description of features of the press will be set forth. In this figure some of the frames 21-26 have been broken away to better show the interrelation of the various components of the apparatus. One may see that a typical hydraulic jack 35 is supported from a block 60 which bears on the top edges of two adjacent frames 22 and 23, for example. The other jacks 36–38 are likewise mounted on blocks similar to block 60. The lower ends of each hydraulic jack 35–38 are each fastened to the top of the upper movable platen 40. Thus, these relatively small jacks are capable of operating at high speed for lowering platen 40 rapidly into engagement with the mold prior to final pressing and for raising the platen rapidly to inactive position after pressing.

Platen 40 may consist of a single, relatively thin, forged or rolled slab 61 and a cast iron wear plate 62 on its lower face. The upper platen wear plate 62 has a plurality of perforation drain grooves (not shown) to permit evacuation or withdrawal of water from the top surface of the mold during pressing of a concrete article. Any suitable vacuum means, not shown, but which are well known in the art may be connected to the drain grooves for effecting this withdrawal.

The use of multiple controlled, high-pressure cylinders 41–46 permits the use of a relatively thin upper platen 40 in relation to its surface area. As will be discussed in greater detail below, the position of each ram of the high power cylinders 41–46 is sensed and to produce error signals which are indicative of the platen position. These error signals are used to control the pressure on the individual rams to insure uniform advancement and thereby prevent excessive deformation in platen 40. The operating mode is such that the total force applied to platen 40 by cylinders 41–46 is maintained constant for a particular mold area. In other words, the lack of resistance in a mold area due to the presence of a window opening, for example, results in the force which would be developed by the cylinder affected being distributed to the other cylinders so that the concrete will always be subjected to a predetermined and preselected total compressive force.

The high pressure hydraulic cylinders 41-46 which apply to the major force to the mold 15 are similarly constructed and mounted so only one of them 45 will be described in detail. Cylinder 45 may, for example, comprise a hollow chamber 65 and an enlarged base 66 which is shown in section in FIG. 2. The base has a horizontal shoulder 67 which reacts against the lower edge of the upper laterally extending portion of frame 24. The base and cylinder are supported on several bolts 68 extending through a plate 69 which is affixed to a sleeve 70 that is supported on tie-bolt 34. A ram 71 is disposed within chamber 65 and its lower end 72 is suitably affixed to the top platen 40. Suitable oil seals (not shown) may be provided around ram 71 as is conventional in hydraulic work cylinders of this type. As explained earlier, movable upper platen 40 cannot drop down inadvertently and extend ram 71 because the platen 40 is held in upper retracted position by the hydraulic jacks 35–38.

Fluid for extending piston 71 out of the chamber 65 of high pressure cylinder 45 is introduced through an inlet 73 at the top of cylinder 65. It should be understood that there would normally be a fitting in inlet 73 connected with a pipe leading back to a source of high pressure hydraulic fluid and alternatively to a reservoir so that the cylinder may be both pressurized and exhausted. The operating mode of the cylinders 41–46 are such that when the upper movable platen 40 is advanced toward the mold in the press by jacks 35–38, fluid is merely drawn into the respective cylinders 41–46. When the jacks 35–38 have advanced platen 40 at high speed to just about the position where it will begin to press the mold, pressure is applied to the more slowly acting but more powerful hydraulic cylinders 41–45 which apply the major pressure to the platen. After the molded concrete article is pressed, suitable valves are operated so as to remove high pressure from each major work cylinder 41–46 and to connect them with a reservoir. Typically, the platen 40 is advanced toward the mold in the press at about two inches per second after which a limit switch, not shown, is operated to cause the rams 71 in the cylinders 41–46 to advance and press at about three inches per minute. Usually, a unit pressure of about 200 to 500 pounds per square inch on the concrete article is used. This pressure is applied until about one-half of the water is squeezed from the concrete slurry after which the platen is retracted and the mold may be conveyed from the press. Retraction of the platen 40 and the jacks 35–38 then results in the rams 71 being retracted so as to discharge the hydraulic fluid from cylinder 65.

In FIG. 2 the mold for a concrete panel is generally designated by the reference numeral 15. This mold is generally rectangular and has long sides 76 and 77 and short sides 78 and 79, the latter 79 not being visible in FIG. 2 but it will be understood to be at the end opposite from short mold side 78. The mold 15 bears on a base plate 80 which is shown broken away at the front of FIG. 2 to reveal how the base plate rests on spaced apart, elongate metal blocks 81 when the mold 15 is in place. As will be discussed hereinbelow, when the mold is described in greater detail, on the underside of the mold base 80 there are downwardly extending ribs which clear the tops of blocks 81 as the mold and its base are advanced into the press. The base is then lowered so that the ribs drop into the spaces between the blocks 81 in which case most of the bottom base plate surface bears on the large area surface which is cummulatively provided by the blocks 81.

The outside surfaces of the mold sides 76–79 are backed up by steel bars such as side bars 82 and end bars 83 when the mold 15 is ready for being pressed. The end bars 83 are pressed against the short sides 78 and 79 of the mold by jaws 85 and 85', respectively. The pressing force for jaws 85 and 85' are obtained with a pair of hydraulic cylinders 86 which are pivotally mounted on blocks 87 by trunnions 88. A piston rod 89 extends from each of the hydraulic cylinders 86 and engages with a bell crank 92 which is pivotally mounted on the lower base or platen 39. The other end of bell cranks 92 engage jaw 85 whereby operation of cylinders 86 effect the positioning of the jaw 85 into and out of its operative position shown in FIG. 2. During the concrete pressing operation, jaw 84 is positioned as shown whereupon it acts to prevent laterally directed hydrostatic pressure from breaking out the short sides of the mold 15. Upon completion of the pressing operations, the jaws 85 and 85' may be removed from the path of the mold so that the mold may be conveyed in or out of the press without interference.

Outside of bar 82 which bears against the long side 76 of mold 75 is a scalloped reinforcing member 95 having spaced apart recesses 96 which are engaged by blocks 98, 99, 100 and 101 for pressing member 95 against bar 82. In this manner, the long sides 76 and 77 of the mold are prevented from deforming outwardly due to lateral hydrostatic pressure. A similar reinforcing member 95 is disposed on the opposite side of the press. When the mold 15 and the side and end bars are introduced between the reinforcing members 95, the latter are wedged inwardly by the vertically beveled blocks 98, 99, 100 and 101 and similar blocks on the opposite sides of each frame 21–26.

Figure 4:
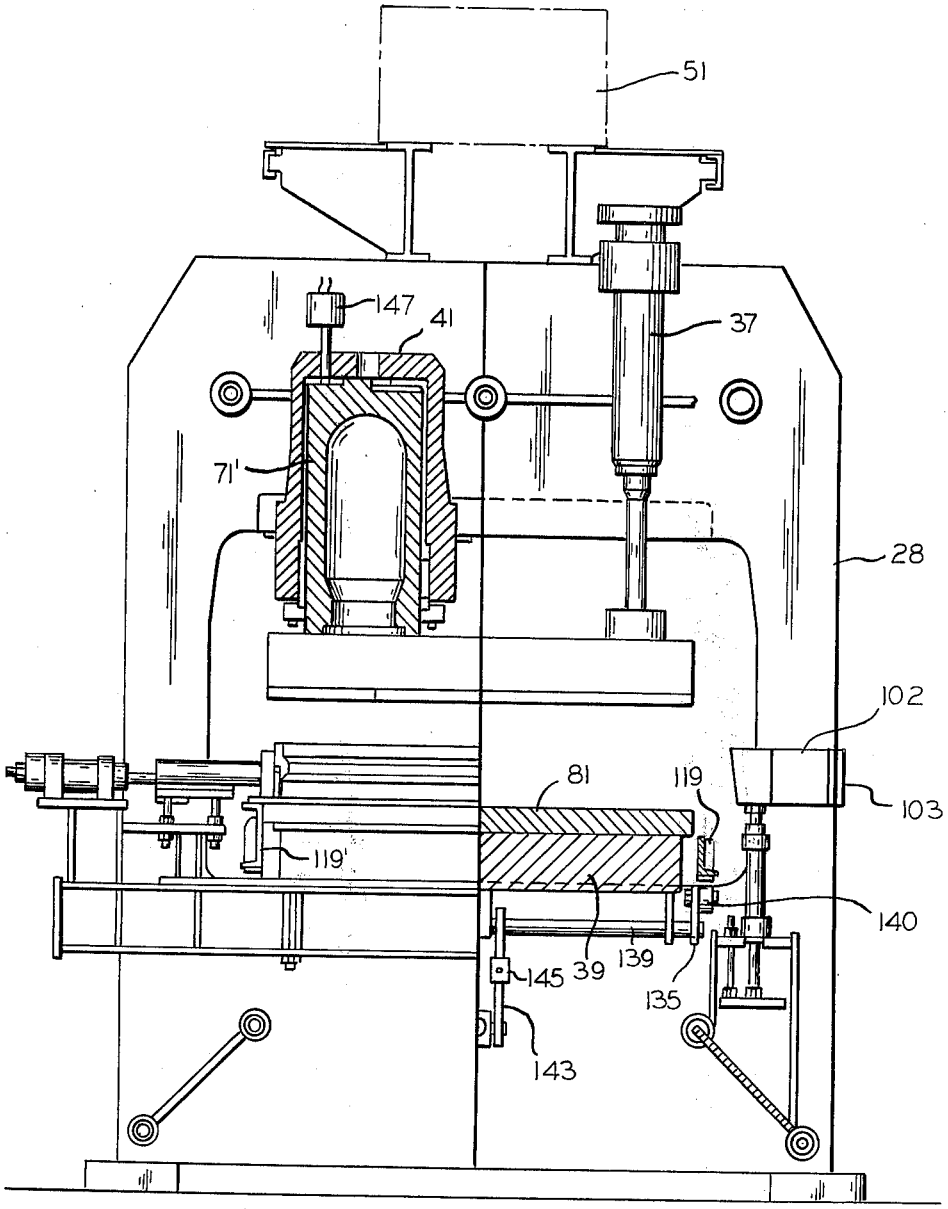
FIG. 4 is a view taken of the press illustrated in FIG. 2 and taken in a vertical transverse plane which is offset so that parts to the left of the center line appear in full lines and parts to the right thereof which are offset appear primarily in section.

Because of the similarity between all of the wedging blocks and their operating devices, only block 98 and its associated parts and functions will be described. Referring now to FIGS. 2 and 4, each wedge block such as 98 is shown to be fastened to a three-sided guide 102 which has a clamping plate 103 that enables adjusting the bracket whereby it fits snugly but slidably on the side leg 28 of frame 23. A hydraulic cylinder 104 is fastened to a bracket 105 and has its piston rod connected with wedge block 98. Cylinder 104 is operable to elevate wedge block 98 with respect to reinforcing member 95 so that the latter is released to provide clearance for conveying a mold through the press. Prior to the pressing operation, however, cylinder 104 is actuated to pull wedge block 98 downwardly so as to exert a wedging or compressive force through reinforcing member 95 and bar 82 to the long side 76 of the mold. It will be appreciated that a pair of identical cylinders 104 will be provided for operating each of the wedge blocks 98-101 at each side of the press one cylinder in the pair 104 is behind the other and is not visible in the drawings. By providing wedge blocks on each long side of the mold corresponding to the number of frame legs, prevents the long sides of the mold from deforming outwardly under the intense pressure which is generated when the concrete is being pressed. Resistance to outward deformation of the long mold sides is further augmented by the legs of press frames 21-26 being placed in high tension when upper movable platen 40 is pressed against a mold 15. In addition, bending in the upper and lower portions of the frames 21-26 tends to deform their legs 28 slightly inwardly to enhance the force on the wedges 98-101 and oppose the counterforce on the mold sides themselves.

When the wet concrete filled mold 15 has been pressed and is ready for discharge from the press, the small hydraulic cylinders 104 are actuated to release the wedge blocks 98-101 from against the reinforcing member 95. To make sure that the mold 15 may be transported freely out of the press, the reinforcing members 95 are also retracted with a plurality of horizontally acting hydraulic jacks 110 on each side of the press. Each jack 110 is keyed to a tongue 112 which projects laterally and integrally from reinforcing member 95. Thus, when all of the wedges are driven upwardly, hydraulic jacks 110 may be actuated to retract reinforcing member 95 and thereby permit free movement of mold 15 from the press. Jacks 110 may also be actuated in the opposite direction to assist with holding the mold sides in place when the mold 15 is first admitted to the press and before the wedges are actuated.

Although the foregoing discussion exemplifies use of hydraulically operated wedges for resisting mold deformation due to lateral hydrostatic forces being developed in the molded product during pressing and for transferring such forces to the side legs of the press frames, it will be appreciated by those skilled in mechanical arts that force resisting means other than wedges may be used as well. For instance, over-center toggle mechanisms, not shown, could be interposed between the side legs of the frames and the mold sides or other intervening elements such as reinforcing member 95. The toggle mechanisms could be released and engaged or extended with mechanical or hydraulic actuators. Eccentric devices such as cams, not shown, could also be interposed between the mold sides and the frames in place of the wedges and the cams could be rotated to selectively release the mold sides or clamp them and thereby transfer lateral forces to the frame during pressing. Even shims, not shown, could be inserted at times when the mold is not pressed so that the shims would tighten when pressing begins and thereby transfer forces to the frames.

Any of the releasable and engageable lateral force resisting devices mentioned in the preceding paragraph and other conceivable devices as well, would contribute to attaining two objects of the invention which are to prevent mold deformation and to permit use of lighter frames in the press. Much of the strength which is built into the frames is to prevent inward buckling of the legs when the upper and lower parts of the frames are subjected to high bending stresses during pressing. The side force resisting devices used herein, however, act to reduce such buckling in which case lighter frames may be used.

Figure 3:
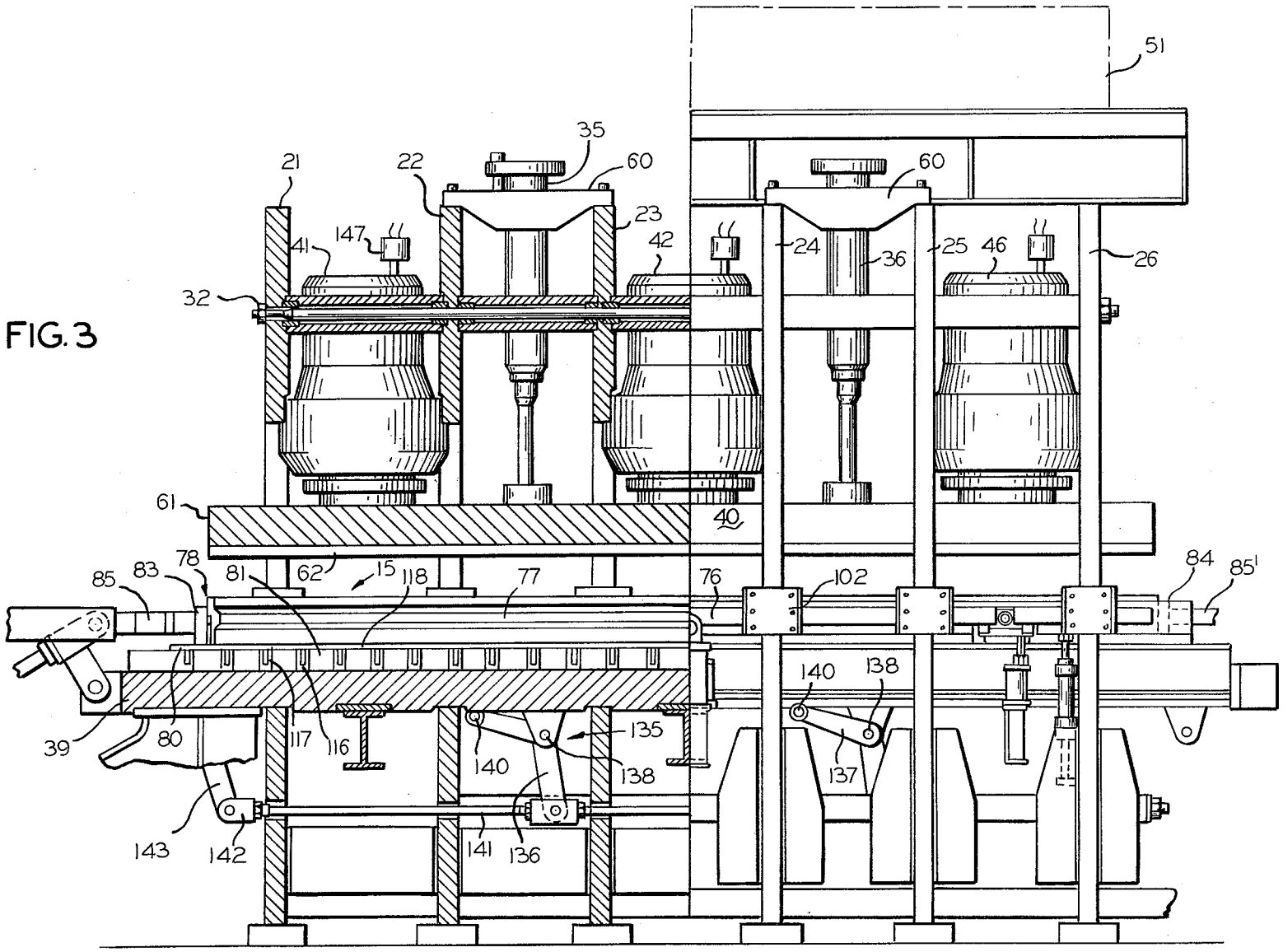
FIG. 3 is a view of a portion of the press illustrated in FIG. 2 and taken in a vertical longitudinal plane which is offset so that parts that are on the rear side of the plane are in section and parts on the front side of the plane appear in full lines.

Some features of the press are further exemplified in FIG. 3 which is a view taken in the direction of the near side of the press as depicted in FIG. 2. In FIG. 3, parts of the press which are beyond the longitudinal center line are shown in section and those which are on the near side of a longitudinal center line are shown in full lines. In this figure, one may see clearly how the pressure hydraulic cylinders 41–46 are interposed between frames 21–26 and upper movable platen 40. The manner in which the fast acting jacks such as 36 are mounted is also more clearly visible.

FIG. 3 also illustrates how the bed or lower stationary platen 39 is supported within the openings of frames 21–26. It will be understood that stationary lower platen 39 may have apertures (not shown) which are connected to a vacuum pump (not shown) for effectuating the removal of water which is squeezed out of the concrete slurry within mold 15 during the pressing operation. Resting on top of platen 39 are the blocks 81 on which the mold base rests in the press. These blocks are spaced apart so as to create gaps 116. Extending into these gaps are a plurality of laterally directed ribs 117 welded onto a base plate 80 which supports mold 15 before it is introduced into the press and while the mold is in the press. It is necessary, therefore, to transport the mold 15 on its base plate 80 into the press at an elevation high enough to permit the ribs 117, which extend from the bottom of the base plate 80, to clear the top faces of base plate supporting blocks 81. The base plate 80 is then lowered so that the ribs 117 drop into the gaps 116 between the blocks 81. When the mold supporting base plate 80 is lowered, it is directly supported on blocks 81 which then prevent the base plate 80 from deforming under pressure.

Figure 5:
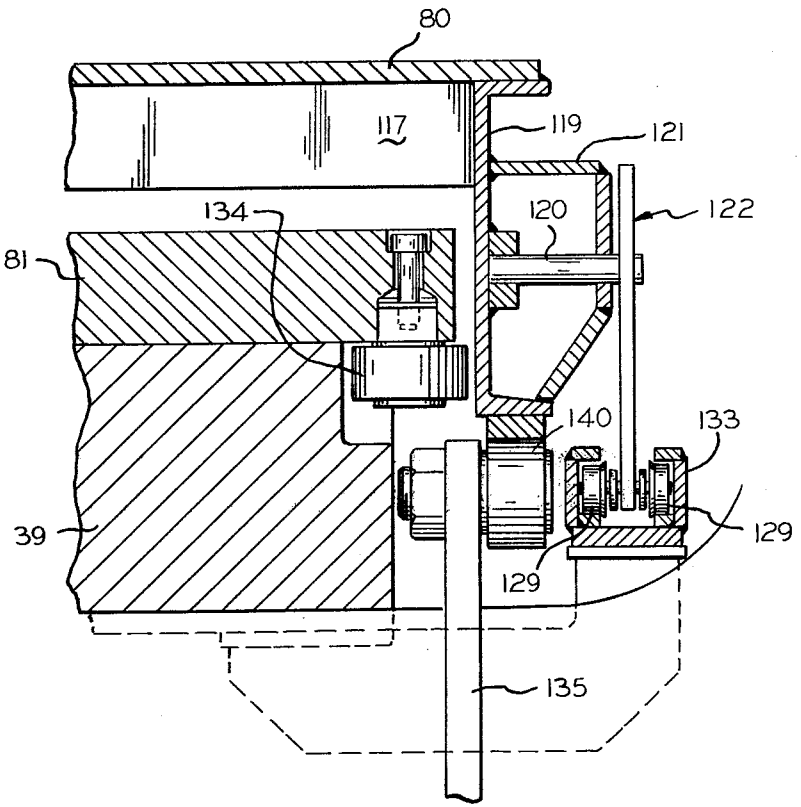
FIG. 5 is a fragmentary vertical section of the mold supporting base and the lower platen of the press illustrated in FIG. 2 when the base is situated in the press.

The mechanism for transporting the mold 15 and base 80 will now be discussed primarily in reference to FIGS. 3–6. The base plate 80 is welded on a pair of parallel longitudinally extending channels 119 and 119'. A pin 120 extends laterally from channel 119 and through a reinforcing frame 121 whereby the end of pin 120 is engageable by a lug 122 having a slot 123 which is defined by a short prong 124 and a long prong 125. Lug 122 is carried by a closed chain 126 consisting of links 127 connected by pins 128 having rollers 129 at their opposite ends. Chain 126 is driven by sprocket type drive, not shown, but which is well known in the art. Within the press, the chain 126 runs in a track 133 which is so constructed as can be seen in FIG. 5 that the lug 122 can also follow the track without interference. When the chain is translated, lug 122 will engage lateral pin 120 and transport mold base 80 into and out of the press. A similar chain drive may be located on the opposite side of the assembly. The mold base 80, and particularly the side channels 119 and 119' are guided in the press by vertical axis rollers 134, see FIG. 5, which are journaled in certain of the mold base supporting blocks 81.

Figure 7:
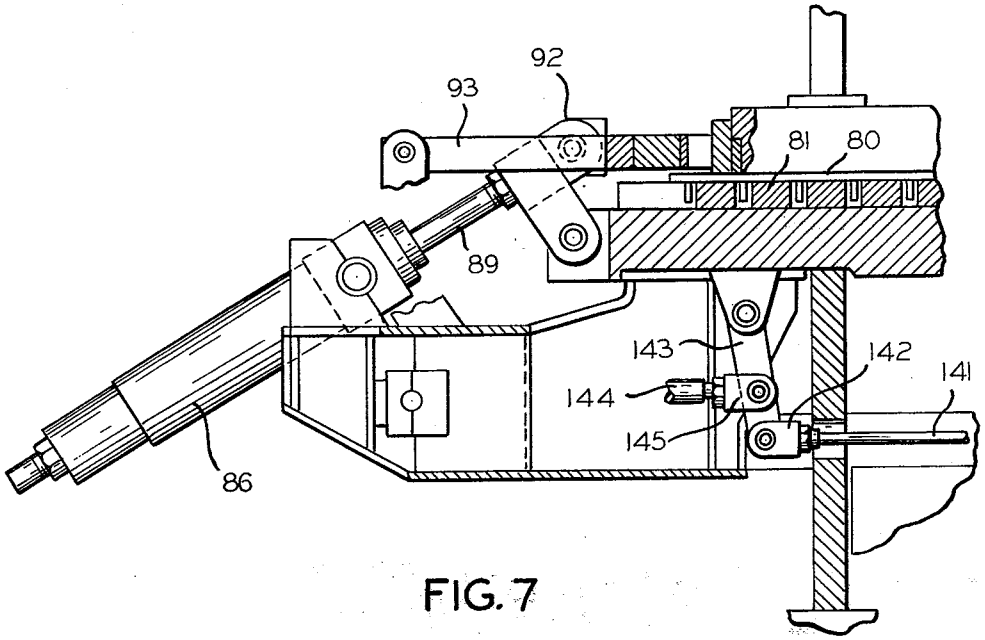
FIG. 7 is a fragmentary view, partly in section, of certain parts of the press that are involved in maintaining pressure on the ends of the mold during pressing.

As mentioned earlier, mold base 80 must be elevated when it is being transported in the press so that the transverse ribs 117 which extend downwardly are not interfered with by the blocks 81. A lifting mechanism is provided for this purpose and comprises a plurality of bell cranks 135 on each side of the press. The bell cranks 135 are each pivotally mounted on shafts 138 which are journaled in lugs that are supported from platen 39 or by any suitable means. The bell cranks have at the end of their corresponding arms a roller such as 140 in FIG. 5. The bell cranks on each side of the press are pivotally connected to connecting rods 141 which terminate in a clevis 142, see FIGS. 3 and 7. As can be seen particularly well in FIG. 7, Clevis 142 pivotally connects to a link 143 to which a driving rod 144 is connected by means of another clevis 145. When an axial force is applied to driving rod 144 by power means which are not shown, all of the bell cranks 135 rock. When the cranks rock in one direction, rollers 140 swing up and engage the lower flange the mold base channels 119 and 119' and elevate the base. When the bell cranks are rocked in the opposite direction, the base 80 is lowered so that it may be supported directly on blocks 81 within the press.

Figure 6:
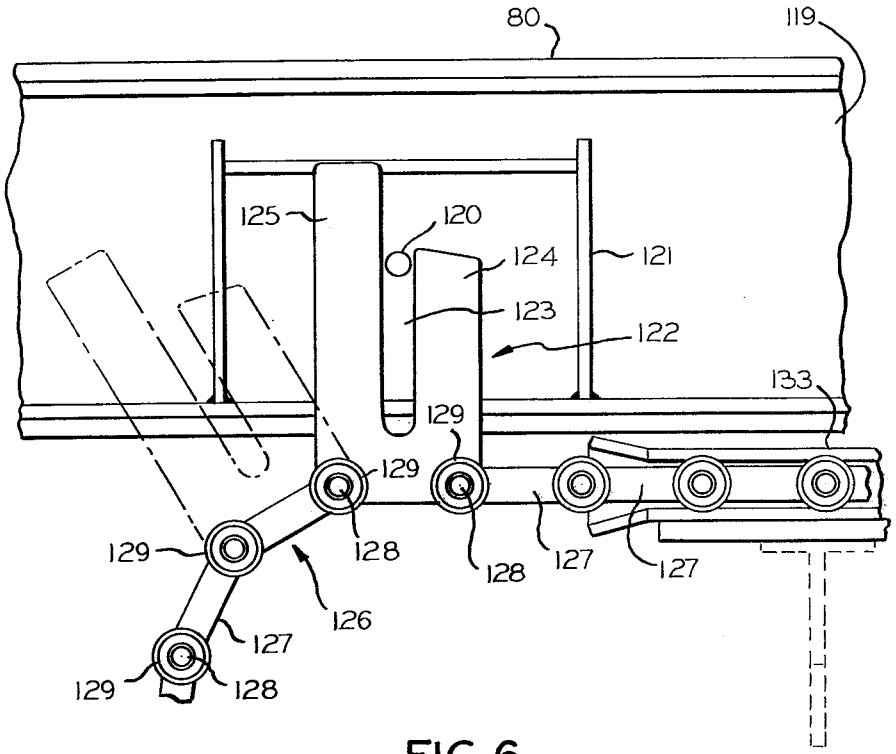
FIG. 6 is a side elevational view of parts of a chain mechanism for transporting the mold supporting base in and out of the press.

When the mold base 80 is to be conveyed into the press, the bell cranks are rocked so as to keep the mold base 80 and the mold 15 thereon elevated. Then, if the chain drive mechanism shown in FIG. 6 is actuated, the long prong 125 of the lug 122 engages pin 120 and causes the mold base to be conveyed. When the mold 15 is in the proper position, the chain drive is stopped and the bell cranks are rocked in such direction that they permit the mold to descend with base 80 for direct support on blocks 81. At this time the pin descends into slot 123 of the chain lug 122.

Referring back to FIG. 2, it will be understood that the bars such as 82 which support the long sides of the mold 15 and bars such as 83 which support the short sides of the mold 15 are positioned on mold base plate 80 before the mold is charged with wet concrete outside of the press. As explained earlier, when the mold is positioned in the press, the hydraulically operated end pressure resisting jaws 84 are actuated into position for pressing against short side bars 83. At this time, the various wedges such as 98 and 99 are driven against reinforcing bar 95 so that its compressive force is transmitted to long side bars 82.

Also briefly alluded to earlier was the fact that all portions of the upper platen 40 of the press are maintained level or even with each other during the pressing operation regardless of differential resistances offered by the concrete mass which might result from door or window openings in the molded product. This is accomplished by using linear voltage differential transformers to detect the vertical elevation of the various rams such as 71 in the power hydraulic cylinders 41–46. The linear voltage differential transformers are visible in connection directly with the power rams shown in FIGS. 2, 3 and 4. The best representation is in FIG. 2 where the linear voltage differential transformer 147 is seen to include a stem 148 which extends through a gland 149 and engages ram 71. As the ram changes vertical elevation, there is a corresponding voltage change in the differential transformer and this variable voltage signal is delivered by means of conductors 150 to suitable servo apparatus, not shown, which compares the signals from the various power cylinders and effectuates an adjustment of the hydraulic pressure on any cylinder that requires adjustment to maintain all cylinders and, hence, all areas of platen 40 level regardless of differences in their resistance to compressive forces exerted by the press. The control apparatus is such that a constant total pressing force is exerted on the platen irrespective of the pressure differences in the various power cylinders 41–46.

Figure 8:
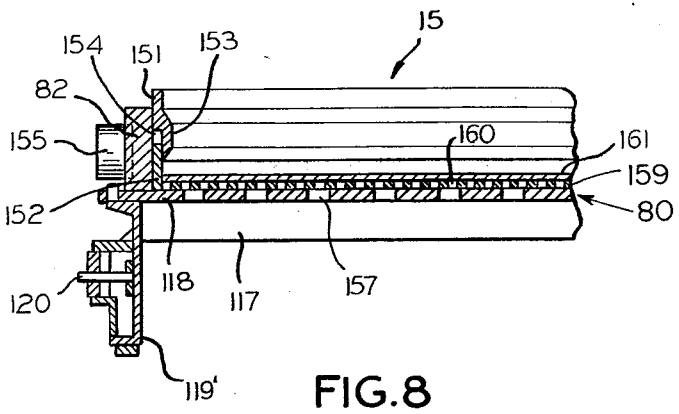
FIG. 8 shows a vertical section of a fragment of a concrete mold as prepared for filling with concrete slurry, the mold being positioned on its supporting base, a fragment of which is in section.

Refer now to FIG. 8 which shows a section of fragment of the mold 15 which is on its supporting base plate 80 and removed from the press. In this view it is evident that the mold 15 comprises upper and lower separable sections 151 and 152. Each of the sections may be comprised of separable side and end pieces which are assembled to form a rectangular mold 15 when viewed from the top. The lower mold section 152 has straight vertical sidewalls and an open top and bottom. Upper section 151 of the mold has an inwardly offset tongue 153. The tongue configuration extends around the interior perimeter of the mold 15 and maintains upper section 151 in alignment with lower mold section 152. As shown in FIG. 8, there is a gap 154 between the mold sections. This gap permits the upper section 151 to telescope into lower section 152 so that the concrete slurry may be pressed to the desired thickness without imposing undue stress on the mold. Mold 15 comprises separable side pieces to facilitate demolding the concrete panels after pressing since, if the mold sections are not made to part or open in at least one place, the tongue 153 will be engaged in the corresponding groove which it produces in the molded product, preventing easy removal of the mold section from the product.

When the mold 15 is on the base 80 as depicted in FIG. 8 and prior to the time that the mold is filled with concrete slurry, the end bars and side bars such as 82 are located next to the mold. As appears in FIG. 8, there are permanent or electrical magnets 155 set into the sides of side bar 82 and the other side and end bars which are adjacent the mold. These magents magnetize the bars and the mold, thus preventing upper section 151 of the mold from telescoping into the lower section 152 prior to the mold being subjected to the force of the press. On the other hand, the magnetic holding means permits the upper and lower mold sections to telescope or slide toward each other when subjected to relatively high pressure. The magnets 155 register in notches such as 156 on the inner faces of reinforcing member 95 as can be seen in FIG. 2 when the mold and its base are lowered. The magnets also register between the prongs of jaws 84 which secure the ends of the molds against lateral hydrostatic pressure during the molding process. When the magnets 155 are electrical, assembly of the mold is facilitated because the magnets can be de-energized to permit proper positioning of the mold sections 151 and 152 and then energized to hold sections 151 and 152 in position. The electrical circuitry for energizing magnets 155 is not shown but is well known in the art.

As shown in FIG. 8, the base plate 80, which supports the mold 15 when the mold is being filled with concrete and when it is in the press, has a plurality of holes 157 which permit draining away water from the mold and the concrete during the pressing process. The upper surface of lower platen 39 may be provided with suitable grooves, not shown, which are connected to a vacuum system, not shown, for inducing the removal of water which has been squeezed out of the concrete slurry during pressing. Deposited on top of base plate 80 within mold 15 is a metal plate 159 which has a plurality of perforations 160 that are considerably smaller than the holes 157 in base plate 80. Superposed on the perforated plate 159 is a porous sheet 161 which may be paper or other porous material. Sheet 161 permits water but no visible solid particles to flow from the concrete slurry through the various apertures 160 in plate 159 and 157 in base plate 80.

After mold 15 is filled with a concrete slurry having a high water-to-cement ration, the slurry is leveled outside of the press and another porous sheet similar to sheet 161 and 159 is deposited on top of the slurry so that water can exude therefrom and be conducted away by means of grooves in the face plate of upper platen 40 and by the vacuum that is applied to the grooves.

As discussed briefly herein above, mold 15 is filled with concrete slurry when it is at position 17 in FIG. 1. When it is prepared as discussed in the preceding paragraph, the slurry filled mold on its base 80 is conveyed by the chain drive lugs 122 into the press at a determined elevation. The bell cranks 135 which support the mold base 80 on rollers are then operated to allow the mold to descend to a position of rest on blocks 81. The upper platen 40 is then brought down at high speed by means of jacks 35–38 to proximity with the mold. During rapid traverse, the main hydraulic cylinders 41–46 are merely filling with fluid. At an appropriate instant, these main or power cylinders are pressurized and the upper platen 40 is squeezed toward the lower platen 39, thus compressing the concrete slurry and driving water out of it and collapsing the mold sections 151 and 152 together as the tongue 153 slides over the inner surface of mold section 152. After a short interval, the bell cranks are again elevated to raise the mold and the chain is started to transport the mold outwardly of the press to position 18 which is observable in FIG. 1. Immediately thereafter, the mold is removed from the product and it remains on its base for being transported to a kiln, not shown, wherein curing is accelerated by heat.

While only a single embodiment of the invention is shown and described, it is not intended to be limited thereby, but only by the scope of the appended claims.

We claim:

1. A press for making articles from a high water-to-cement ratio concrete slurry, said press comprising a plurality of spaced apart, generally vertically oriented frame means disposed adjacent the opposite sides of and defining a platen receiving space, upper and lower platen means disposed within said space in generally parallel spaced apart relation, said lower platen means being constructed and arranged to support a concrete containing mold having sides presented toward the frame means on the opposite sides of said space, first force producing means coupled to one of said platen means for moving the same toward the other of said platen means thereby to compress the concrete in said mold, a plurality of wedge means, at least one of said wedge means being disposed between each of the sides of said mold and said frame means disposed on each of the sides of said space, each of said wedge means being mounted for generally vertical movement into and out of high pressure wedging engagement between the respectve sides of said mold and said spaced apart frame means on the opposite sides thereof for exerting a force inwardly toward said mold in opposition to the forces tending to deform the mold laterally as said mold is compressed between said platen means, selectively operable force producing means for selectively moving each of said wedge means vertically on said frame means and into and out of high pressure engagement with the adjacent side of said mold, means for conveying said mold into and out of said space through the ends of said frame means, pivotally mounted clamping means positioned adjacent the path of said mold and each of the ends of said mold, and third force producing means operatively connected to said clamping means for selectively pivoting said clamping means out of said mold path and into said path for exerting a longitudinal clamping force on the ends of said mold and for moving said clamping means out of the path of said mold to permit insertion and withdrawal thereof.

2. The invention set forth in claim 1 wherein said wedge means comprises wedging members mounted on said frame means for sliding generally vertical movement between said frame means ad said mold, said wedging members having an inclined surface presented toward said mold side whereby said inwardly directed forces are increased or decreased as said members are moved in one generally vertical direction or the other on said frame means.

3. The invention set forth in claim 2 wherein a plurality of said frame means are provided and each includes generally vertically extending opposed side leg portions joining a laterally extending portion and spaced from said mold sides, said portions defining said platen receiving space, one of said wedging members being disposed on each of a plurality of said side leg portions at each side of said mold and between said leg portions and said mold.

4. The invention set forth in claim 3 and including an elongate force transmitting member disposed between the sides of said mold and said wedging members for distributing the force exerted thereby to said mold sides.

5. The invention set forth in claim 4 wherein said selectively operable means includes hydraulic cylinder means coupled to each of said wedging members for exerting a force thereon generally parallel to said mold sides for moving said wedging member into and out of said high pressure wedging engagement with said mold sides and for maintaining said pressure during the molding operation.

6. A press for making articles from a hgih water-to-cement ratio concrete slurry, said press comprising:

a plurality of generally vertically oriented frame means, each of said frame means including an upper, laterally extending portion, and generally vertically extending opposed side leg portions joining said laterally extending portion, said portions defining a platen receiving space, upper and lower platen means disposed within said space in generally parallel spaced apart relation, said lower platen means being constructed and arranged to support a concrete containing mold one of said platen means being movable toward the other, a plurality of wedging members, one of said wedging members being disposed between at least some of said side leg portions and said mold and engageable therewith, first force producing means is coupled to said frame means and to said movable platen means for moving the same toward the other platen means to compress the concrete in said mold and so that said frame means is subjected to tensile stress when said movable platen means is moved into high pressure engagement with said mold, said wedging members being mounted on said frame means for sliding vertical movement between their associated side leg portions and said mold, said wedging members having an inclined surface presented toward said mold whereby said inwardly directed forces are increased or decreased as said members are moved in one vertical direction or the other on said frame means, selectively operable force producing means operative to force said wedging members into and out of high pressure welding engagement with said mold and said frame means, an elongate force transmitting member disposed between the sides of said mold and said wedging members for distributing the force exerted thereby to said mold sides, means for conveying said mold into and out of said space through the ends of said frame means, pivotally mounted clamping means positioned adjacent the path of said mold and each of the ends of said mold, and third force producing means operatively connected to said clamping means for selectively pivoting said clamping means out of said mold path and into said path for exerting a longitudinal clamping force on the ends of said mold during a molding operation and for moving said clamping means out of the path of said mold to permit insertion and withdrawal thereof.

7. The invention set forth in claim 6 wherein said first force producing means comprises a plurality of extensible and contractible hydraulic work cylinders each coupled to the laterally extending portions of said frame means and to said upper platen means for moving the same vertically, said lower platen means being fixedly supported.

8. The invention set forth in claim 7 including support means disposed along laterally opposed sides of said platen receiving space for supporting a mold at an elevation above said stationary lower platen means when the mold is transported between said platen means, and elevating means operatively coupled with said support means for selectively moving the same to said elevation and for lowering said mold onto said stationary lower platen means.

9. The invention set forth in claim 8 including conveyor means for conveying a mold that is supported on base means through said press, said conveyor means comprising roller chain means and longitudinally spaced apart base engaging means carried thereby, said chain means being disposed for translation on laterally opposite sides of said platen receiving space, means operable between two positions and adapted to support a mold base while it is being conveyed in said space, said elevating means when operated to at least one position elevating said mold supporting base means so as to be engageable by said base engaging means on said chain means, the aforesaid base engaging means being constructed and arranged to permit said base means to be lowered from its elevated position in said press while said engaging means are engaged.

10. A press for molding concrete articles from a concrete slurry of high water-to-cement ration, comprising:

frame means having vertically spaced upper and lower laterally extending parts and laterally opposite leg means extending downwardly from said upper parts, said parts and leg means defining an opening in the frame means, a stationary horizontally disposed lower platen mounted in said opening on said lower part for receiving a mold having sides facing said leg means, an upper horizontally disposed movable platen in said opening above said lower platen means and defining a mold receiving space therebetween, extensible and contractible hydraulic work cylinder means connected to said upper platen and reacting between said platen means and said laterally extending upper part of the frame means, and force transmitting means interposed between opposite sides of said mold and said opposite leg means for transmitting to said leg means and transversely thereto lateral forces generated in a mold when it is being pressed between said platens and for producing a positive counter force directed inwardly toward said mold, said force transmitting means comprising a generally vertically movable wedge element slidably mounted on said leg means disposed between each of said leg means and engageable with said mold sides, and hydraulic cylinder means for selectively moving each of said elements generally vertically and into and out of high pressure wedging engagement between said leg means and said mold sides and for maintaining said positive counter force during the molding operation, means for conveying said mold into and out of said opening throuugh the ends of said frame means, pivotally mounted clamping means positioned adjacent the ends of said frame means, said clamping means having a first position displaced from the path of said mold and a second position for engaging a mold in said opening, and force producing means operatively connected to said clamping means for selectively pivoting said clamping means between its first and second positions and into and out of high pressure longitudinal clamping engagement with the ends of said mold and for moving said clamping means out of the path of said mold to permit insertion and withdrawal thereof.

* * * * *